US006799946B1

(12) United States Patent
Neisen

(10) Patent No.: US 6,799,946 B1
(45) Date of Patent: Oct. 5, 2004

(54) PROPELLER ASSEMBLY

(75) Inventor: Gerald F. Neisen, Rockport, TX (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 09/547,593

(22) Filed: Apr. 11, 2000

(51) Int. Cl.[7] ..... B63H 20/14; B63H 1/20

(52) U.S. Cl. ..... 416/134 R; 416/169 R; 464/39

(58) Field of Search ..... 416/134 R, 169 R, 416/244 R, 245 A, 244 B, 247 A, 93 A; 440/89, 47, 88, 900; 464/159, 39

(56) References Cited

U.S. PATENT DOCUMENTS 1,515,100 A * 11/1924 Foster ..... 192/108
1,860,750 A * 5/1932 Riggs ..... 192/108 X
2,950,797 A * 8/1960 Zieher ..... 192/108
3,136,400 A * 6/1964 Carr ..... 464/39
3,880,267 A * 4/1975 Auble et al. ..... 192/108
4,566,855 A * 1/1986 Costabile et al. ..... 416/134 R
4,842,483 A * 6/1989 Geary ..... 416/93 A
5,201,679 A * 4/1993 Velte, Jr. et al. ..... 416/134 R
5,415,575 A * 5/1995 Karls ..... 416/39
5,908,284 A * 6/1999 Lin ..... 416/134 R
5,967,751 A * 10/1999 Chen ..... 416/134 R
6,086,282 A * 7/2000 Dutt et al. ..... 464/39

FOREIGN PATENT DOCUMENTS

DE 4138917 A1 * 11/1992 ..... B60K/17/34

* cited by examiner

*Primary Examiner*—Edward K. Look
*Assistant Examiner*—Richard A. Edgar
(74) *Attorney, Agent, or Firm*—BRP Legal Services

(57) ABSTRACT

A propeller assembly includes an interchangeable drive sleeve, an inner hub, a biasing member forcing the drive sleeve into contact with the inner hub, and a propeller including an outer hub in which the drive sleeve and inner hub are inserted. In an exemplary embodiment, the drive sleeve includes a plurality of teeth that engage a plurality of teeth on the inner hub. The spring is configured to permit the drive sleeve to move axially away from the inner hub upon the occurrence of a sufficient torque and allow the drive sleeve to rotate relative to the inner hub. A bore extends through drive sleeve, and a plurality of grooves are in an inner diameter surface of the drive sleeve bore. These grooves are configured to mate with splines on a propeller shaft. The inner hub includes a plurality of keys and the outer hub includes a plurality of complimentary keyways to limit relative movement between the inner hub drive flange and the outer hub.

28 Claims, 5 Drawing Sheets

PROPELLER ASSEMBLY

BACKGROUND OF THE INVENTION

The invention relates generally to marine engines, and more particularly, to propeller hubs.

Outboard engines include a drive shaft extending from an engine power head, through an exhaust case, and into an engine lower unit. The lower unit includes a gear case, and a propeller shaft extends through the gear case. Forward and reverse gears couple the propeller shaft to the drive shaft. The drive shaft, gears, and propeller shaft sometimes are referred to as a drive train.

A propeller is secured to and rotates with the propeller shaft. Torque from the propeller is transmitted to the shaft. Specifically, propeller hub assemblies transmit torque to the propeller shaft. Exemplary propeller hub assemblies include cross bolts, keys, shear pins, plastic hubs, and compressed rubber hubs.

Such hub assemblies should have sufficient strength or stiffness so that during normal engine operations, very few losses occur between the propeller shaft and the propeller. Such hub assemblies, however, also should be resilient so that the engine drive train is protected in the event of an impact, e.g., if the propeller hits a log or rock. Further, since engine manufacturers often utilize different propeller shaft arrangements, it would be desirable to provide propeller hub assemblies that facilitate use of one propeller on engines of different engine manufacturers.

BRIEF SUMMARY OF THE INVENTION

In an exemplary embodiment, a propeller assembly includes an inner hub, an interchangeable drive sleeve that mates with the inner hub, a biasing member that biases the drive sleeve into contact with the inner hub, and a propeller including an outer hub in which the inner hub and drive sleeve are inserted. More particularly, the inner hub includes a plurality of teeth that mate with a corresponding plurality of drive sleeve teeth.

The drive sleeve includes a first body portion and a second body portion. The second body portion has a larger diameter than the first body portion and includes drive sleeve teeth. A bore extends through the drive sleeve, and a plurality of splines are in an inner diameter surface of the drive sleeve bore. The splines are configured to mate with a plurality of splines on a propeller shaft that extends through the bore.

The inner hub includes a plurality of drive keys that mate with a plurality of grooves in an inner surface of the outer hub. The inner hub teeth are at an end of the inner hub and mate with the drive sleeve teeth. The biasing member contacts the drive sleeve and biases the drive sleeve into contact with the inner hub such that rotation of the inner hub rotates with the drive sleeve.

The outer hub includes a cylindrical shaped body. A plurality of blades extend from an outer diameter surface of the outer hub body. An inner diameter surface of the outer hub body is shaped to mate with the inner hub drive keys to limit relative movement between the inner hub and the outer hub.

During operation, and upon the occurrence of an impact, the drive sleeve compresses the biasing mechanism and the drive sleeve teeth slip with respect to the inner hub teeth. Thus, the propeller shaft and drive sleeve are permitted to rotate with respect to the inner hub and propeller outer hub. The operational condition in which the drive sleeve teeth slip with respect to the inner hub teeth is sometimes referred to herein as the resilient operation mode.

The above described propeller assembly facilitates the easy replacement of the inner hub. Specifically, in the event that the inner hub needs to be replaced, a user simply removes the propeller assembly from the propeller shaft, and removes the drive sleeve and inner hub from within the outer hub. A replacement drive sleeve and/or inner hub can then be utilized when reassembling the propeller assembly and mounting the assembly on the propeller shaft.

Further, different drive sleeves can be provided so that the propeller can be utilized on many different types of marine engines. For example, one particular marine engine may have splines on the propeller shaft of a first length, and another particular marine engine may have splines on a propeller shaft of a second length. Different drive sleeves having different length splines on their inner diameter surfaces can be provided. Although different drive sleeves are utilized, a same propeller can be used. That is, by providing interchangeable drive sleeves, one propeller can be used in conjunction with many different type engines.

DETAILED DESCRIPTION OF THE INVENTION

The present invention is not limited to practice in connection with a particular engine, nor is the present invention limited to practice with a particular propeller configuration. The present invention can be utilized in connection with many engines and propeller configurations. For example, a propeller having three blades is described herein. The present invention, however, can be used in connection with propellers having any number of blades. Therefore, although the invention is described below in the context of an exemplary outboard engine and propeller configuration, the invention is not limited to practice with such engine and propeller.

Figure 1:
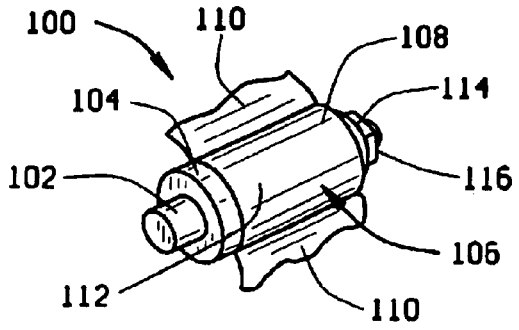
FIG. 1 is a front perspective view of a propeller assembly in accordance with one embodiment of the present invention.

FIG. 1 is a front perspective view of a propeller assembly 100 in accordance with one embodiment of the present invention. Propeller assembly 100 is configured for being secured to a propeller shaft 102 of a marine engine. Propeller assembly 100 includes a thrust washer 104, a propeller 106 having an outer hub 108 and a plurality of blades 110 extending from an outer diameter hub surface 112, a washer 114, and a nut 116 which secures assembly 100 to propeller shaft 102.

Generally, propeller assembly 100 rotates with propeller shaft 102 during normal operations. In the event of an impact, e.g., propeller 106 strikes an object in the water, propeller 106 may rotate relative to shaft 102 as described below in more detail to protect an engine drive train.

Figure 2:
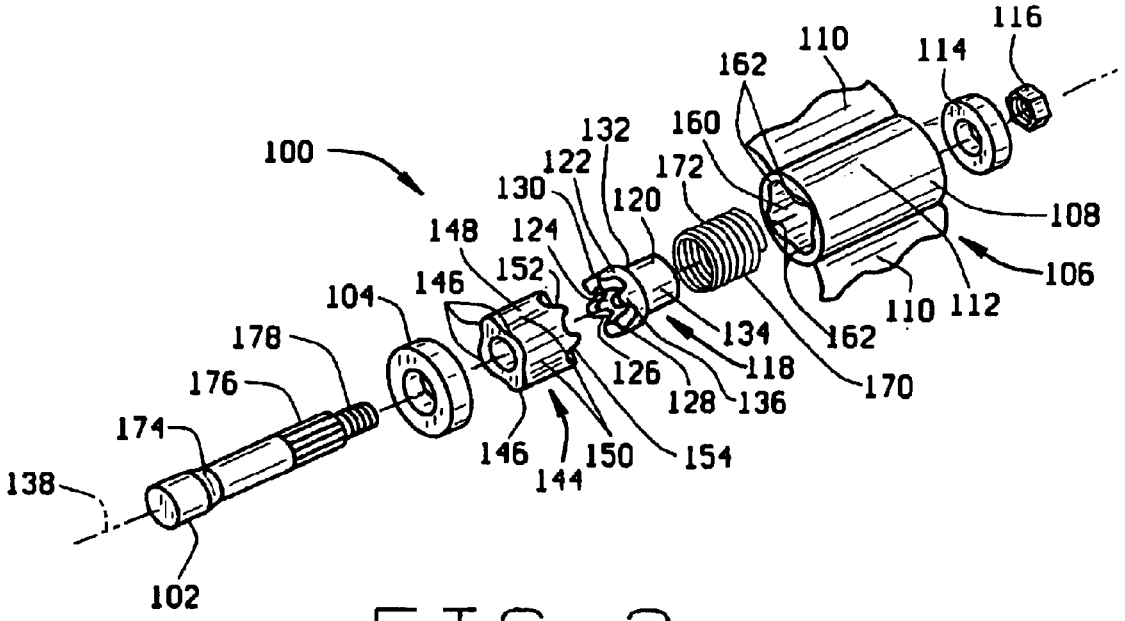
FIG. 2 is an exploded view of the propeller assembly shown in FIG. 1.

FIG. 2 is an exploded view of propeller assembly 100. As shown in FIG. 2, assembly 100 also includes a drive sleeve 118 having a first portion 120 and a second portion 122. A plurality of grooves 124 are in an inner diameter surface 126 of drive sleeve 118. Second portion 122 has a larger outer diameter than first portion 120 and includes a plurality of teeth 128 that extend from an end 130 of second portion 122. Drive sleeve 118 further includes a ledge 132 that extends between an outer diameter outer surface 134 of first portion 120 and an outer diameter outer surface 136 of second portion 122. Ledge 132 is substantially perpendicular to an axis 138 of propeller shaft 102. In an exemplary embodiment, drive sleeve 118 is fabricated from an extruded plastic.

Assembly 100 also includes an inner hub 144. A plurality of keys 146 are formed on an outer diameter surface 148 of inner hub 136. Keys 146 are shaped to tightly mate with outer hub 108. Specifically, and in the embodiment shown in FIG. 2, inner hub 144 includes four keys 146 spaced by intermediate sections 150. Inner hub 144 also includes a plurality of teeth 152 that extend from an end 154 thereof. Inner hub teeth 152 are complimentary to drive sleeve teeth 128 such that rotation of drive sleeve 118 causes rotation of inner hub 144.

Outer hub 108 includes a bore 160 shaped so that inner hub 144 and keys 146 tightly fit within bore 160. Bore 160 includes a plurality of keyways 162 that accommodate keys 146. In addition, drive sleeve 118 has an outer diameter less than an inner diameter of bore 160. Therefore, inner hub 144 fits tightly within outer hub 108, while drive sleeve 118 rotates relative to outer hub 108.

Assembly 100 further includes a biasing mechanism 170 that extends between washer 114 and drive sleeve second portion 122. In one embodiment, biasing mechanism 170 extends between an end wall (not shown) of outer hub 108 and second portion 122 of drive sleeve 118. Biasing mechanism 170, in the particular embodiment illustrated in FIG. 2, is a helical spring 172 extending between and contacting ledge 132 and the outer hub end. In an alternative embodiment, biasing mechanism 170 is a resilient grommet that contacts drive sleeve 118 and the outer hub end.

Biasing mechanism 170 biases drive sleeve 118 into contact with inner hub 144 such that drive sleeve teeth 128 mesh with inner hub teeth 152 and inner hub 144 rotates with drive sleeve 118. In the event of an impact, drive sleeve 118 will continue to rotate at a same speed while inner hub 144 and outer hub 108 slow, or stop, their rotation, as described below in greater detail. Inner hub 144 is fabricated from a material, such as brass, which provides frictional contact between inner hub teeth 152 and drive sleeve teeth 128 sufficient to drive outer hub 108 up to a preset load limit and permit inner hub teeth 152 and drive sleeve teeth 128 to rotate relative to each other above that preset load limit such that drive sleeve 128 rotates relative to outer hub 108.

Outer hub 108 has a cylindrical shape and blades 110 extend from outer diameter surface 112 of outer hub 108. As explained above, bore 160 is shaped to mate with inner hub outer diameter surface 148 to limit relative movement between inner hub 144 and outer hub 108. Propeller 106 can be cast from aluminum, stainless steel, or other materials.

Propeller shaft 102 has a tapered section 174 for mating with thrust washer 104, and a splined section 176 for mating with drive sleeve grooves 124. Propeller shaft 102 also includes a threaded section 178 for engagement with nut 116. Different engines may have different length splined sections, and as described below in more detail, by simply using a mating drive sleeve, one propeller (e.g., propeller 106) can be used on such different engines.

Figure 3:
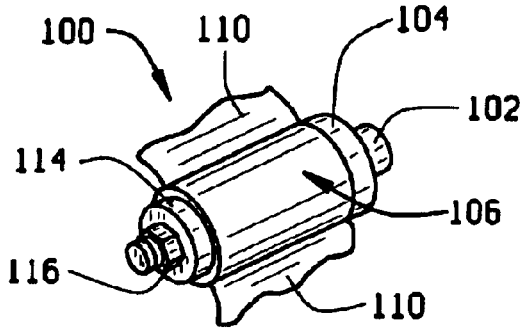
FIG. 3 is a rear perspective view of the propeller assembly shown in FIG. 1.

FIG. 3 is a rear perspective view of propeller assembly 100. To secure propeller 106 to propeller shaft 102, an outer hub assembly is formed by inserting biasing mechanism 170 (shown in FIG. 2) and drive sleeve 118 (shown in FIG. 2) into outer hub bore 160. Inner hub 144 is then inserted into outer hub bore 160.

Thrust washer 104, propeller 106, and outer hub 144 (shown in FIG. 2) are then pushed over propeller shaft 102 so that propeller shaft 102 extends through and engages drive sleeve 118. Washer 114 is then pushed over shaft 102, and threaded nut 116 is tightened on shaft 102 to secure propeller 106 to shaft 102. As shown in FIG. 3, nut 116 is tightened on propeller shaft 102 so that washer 114 is tightly secured against outer hub 108.

Figure 4:
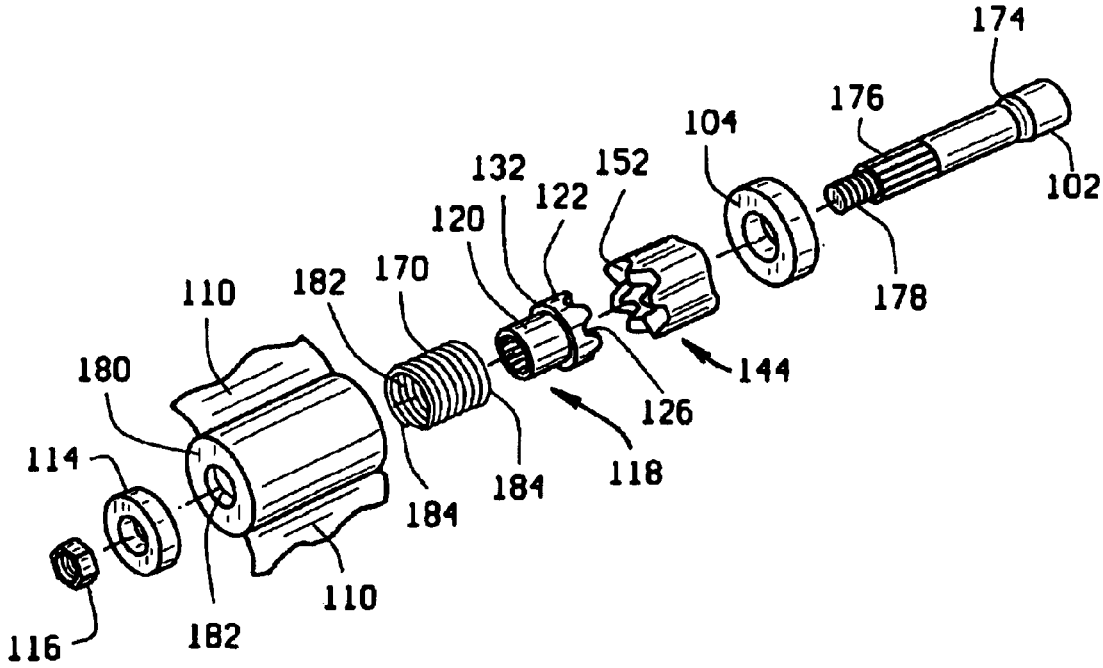
FIG. 4 is an exploded view of the propeller assembly shown in FIG. 3.

FIG. 4 is an exploded view of propeller assembly 100. As shown in FIG. 4, outer hub 108 includes an end 180 having an opening 182 therethrough. Washer 114 contacts end 180. In addition, biasing member 170 contacts end 180 and is positioned between end 180 and drive sleeve ledge 132. In the particular embodiment shown in FIG. 4, biasing member 170 is a spring 172, such as a compression spring. Spring 172 includes a pair of ends that are closed and ground which provides better load transferring capability than a spring with open ends that are not ground.

Figure 5:
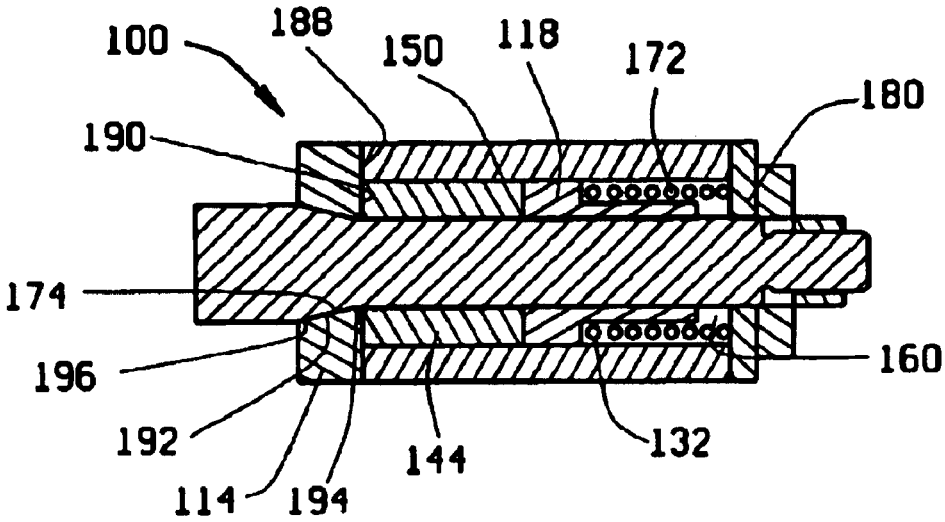
FIG. 5 is a side cross-sectional view of the propeller assembly shown in FIG. 1.

FIG. 5 is a side cross-sectional view of propeller assembly 100 along inner hub intermediate sections 150. An outer diameter of drive sleeve 118 and an outer diameter of inner hub intermediate sections 150 are substantially similar. In the embodiment shown in FIG. 5, drive sleeve 118 has a substantially uniform outer diameter that corresponds to the outer diameter of inner hub intermediate sections 150. Drive sleeve 118 is sized to rotate within outer hub bore 160 without engaging keyways 162 (shown in FIG. 2).

As shown in FIG. 5, drive sleeve 118 is biased into contact with inner hub 144 by spring 172. Spring 172 extends between outer hub end 180 and drive sleeve ledge 132. Spring 172, drive sleeve 118 and inner hub 144 are maintained within outer hub 108 with washer 104 which contacts an end 188 of outer hub 108 and an end 190 of inner hub 144. Washer 104 has a tapered inner surface 192 complimentary to propeller shaft tapered portion 174 such that a washer bore first end 194 has a first diameter and a washer bore second end 196 has a second diameter. The second diameter is greater than the first diameter.

Figure 6:
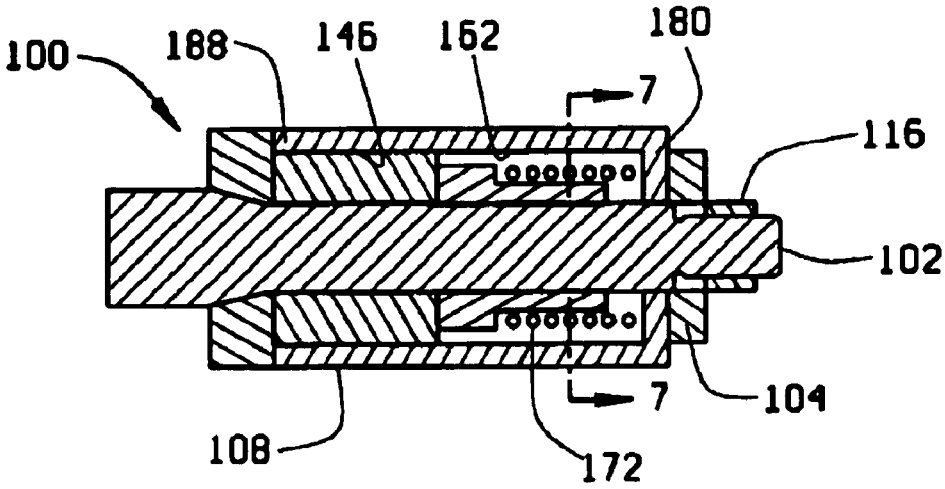
FIG. 6 is another cross-sectional view of the assembly shown in FIG. 5.

FIG. 6 is a side cross-sectional view of propeller assembly 100 along inner hub keys 146. An outer diameter of inner hub keys 146 is larger than an outer diameter of drive sleeve 118. In the embodiment shown in FIG. 6, outer hub keyways 162 extend from first outer hub end 180 to second outer hub end 188. Thrust washer 104 has a shape complimentary to a shape of propeller shaft 102 and is maintained in contact with outer hub first end 180 by nut 116.

Figure 7:
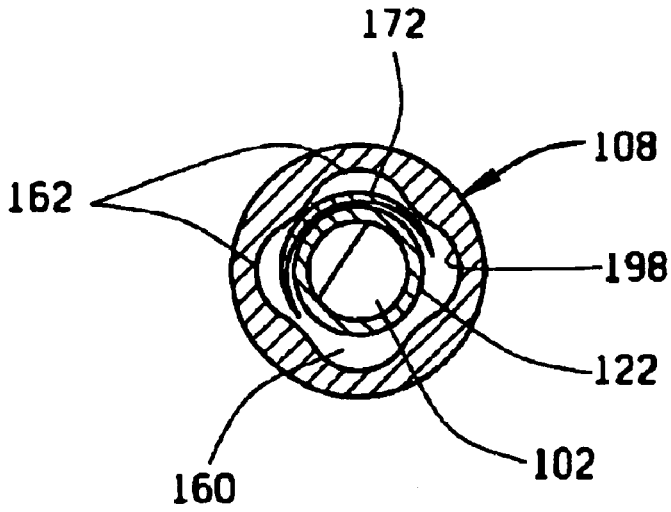
FIG. 7 is a cross-sectional view through line 7—7 shown in FIG. 6.

FIG. 7 is a cross-sectional view through line 7—7 shown in FIG. 6. As shown in FIG. 7, spring 172 extends between drive sleeve first portion 122 and an outer hub inner surface 198. Drive sleeve first portion 122 tightly fits against propeller shaft 102 and engages propeller shaft 102 via the spline arrangement described above.

Figure 8:
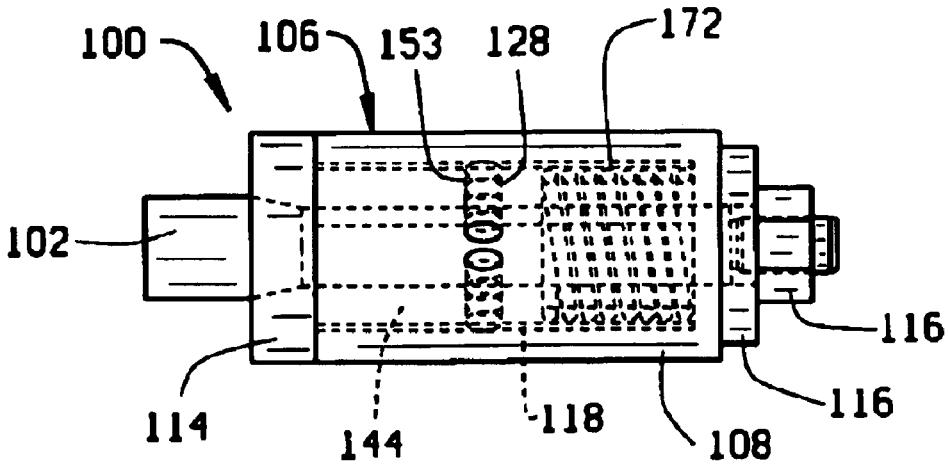
FIG. 8 is a cut-away side view of the propeller assembly shown in FIG. 1.

FIG. 8 is a cut-away side view of propeller assembly 100 showing spring 172 forcing drive sleeve 118 into contact with inner hub 144 such that drive sleeve teeth 128 engage inner hub teeth 152. The compression force of spring 172 is sufficient such that during normal operations, torque is efficiently transferred from propeller shaft 102 to propeller 106 through drive sleeve 118 and inner hub 144 and drive sleeve teeth 128 maintain engagement with inner hub teeth 152.

Figure 9:
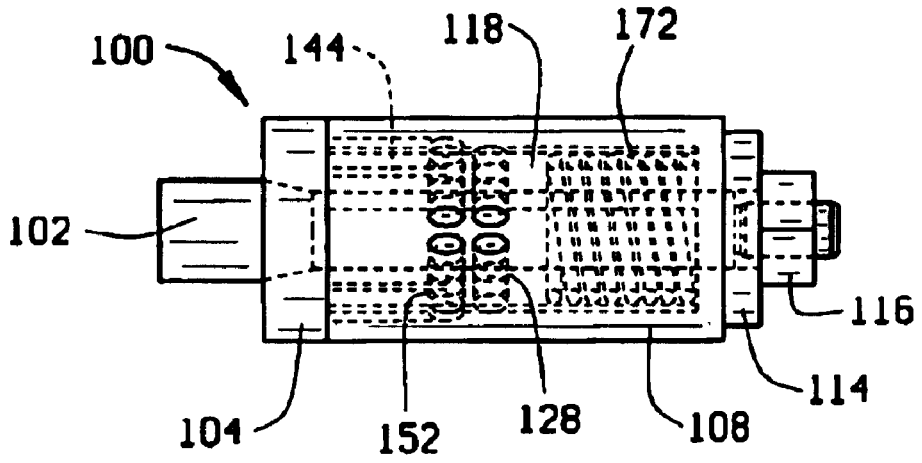
FIG. 9 is a cut-away side view of the propeller assembly shown in FIG. 1 in the resilient mode.

FIG. 9 is a cut-away side view of propeller assembly 100 showing spring 172 in a compressed state such that drive sleeve teeth 128 do not engage inner hub teeth 152. Drive sleeve teeth 128 and inner hub teeth 152 are configured to maintain engagement up to a preset torque, such as 1000 lbf. Above the preset torque, the configuration of teeth 128 and 152 causes drive sleeve 118 to move axially away from inner hub 144 such that drive sleeve teeth 128 do not engage inner hub teeth 152 and drive sleeve 118 rotates with respect to inner hub 144. In one exemplary embodiment, spring 172 has the following characteristics.

Wire properties

| | |
|---|---|
| $d = 0.18$ in | wire diameter |
| $D = 1.6$ in | mean spring diameter |
| $G = 10 \times 10^6$ | shear modulus |

$C = \frac{D}{d}$ $C = 8.889$ — exemplary range of C is from 5 to 9

Calculation of spring force given a prescribed deflection
For a plain spring,

| | |
|---|---|
| $Ne = 0$ | end coils |
| $Na = 45$ | number of active coils |
| $Nt = Na$ | total coils |
| $p = 0.35$ in | pitch |
| $Lo = p(Na) + d$ | free length, limit is 2 in |
| $Lo = 1.755$ in | |
| $Ls = d(Nt + 1)$ | solid length |
| $Ls = 0.99$ in | |

$$OD = \sqrt{D^2 + \left(\frac{p^2 - d^2}{\pi^2}\right) + d}$$ outside diameter of spring at solid length max := 2.23 in $OD = 1.783$ in
$\delta = 0.35$ in — prescribed deflection
$Lo\text{-}Ls = 0.765 \text{ in} > 2\delta = 0.7$ in $$Fs = \frac{d^4 G(\delta)}{8D^3 Na}$$ spring force $Fs = 24.917$ lbf Shear stress calculations $$Kw = \frac{4C - 1}{4C - 4} + \frac{0.615}{C}$$ stress factor $$\tau s = Kw \frac{8FsD}{\pi d^3}$$

$Sut = 75000$ psi — stainless steel 302 spring
$Ssy = 0.35\ Sut$ $$n = \frac{Ssy}{\tau s}$$

$n = 1.3$

-continued

For a squared and ground spring

| | |
|---|---|
| $Ne = 2$ | end coils |
| $Na = 4.5$ | number of active coils |
| $Nt = Na + 2$ | total coils |
| $p = 0.35$ in | pitch |
| $Lo = p(Na) + 2d$ | free length, limit is 2 in |
| $Lo = 1.935$ in | |
| $Ls = dNt$ | solid length |
| $Ls = 1.17$ in | |

$$OD = \sqrt{D^2 + \left(\frac{p^2 - d^2}{\pi^2}\right) + d}$$ outside diameter of spring at solid length max := 2.23 in $OD = 1.783$ in
$\delta = 0.35$ in — prescribed deflection
$Lo\text{-}Ls = 0.765 \text{ in} > 2\delta = 0.7$ in $$Fs = \frac{d^4 G(\delta)}{8D^3 Na}$$ spring force $Fs = 24.917$ lbf Shear stress calculations $$Kw = \frac{4C - 1}{4C - 4} + \frac{0.615}{C}$$ stress factor $$\tau s = Kw \frac{8FsD}{\pi d^3}$$

$Sut = 75000$ psi — stainless steel 302 spring
$Ssy = 0.35\ Sut$ $$n = \frac{Ssy}{\tau s}$$

$n = 1.3$

RUBBER GROMMET AS SPRING

T = Breakaway torque
$F_{Rub}$ = Force on rubber grommet @ a given torque
R = Radius at which surfaces between brass extrusion and plastic part make contact
$\mu = 0.35$ $\theta = 20$ deg $T = 1000$ ft lbf $R = 0.78$ in $$F_{Rub} = \frac{-T(\mu\cos(\theta) - \sin(\theta))}{R(\cos(\theta) + \mu\sin(\theta))}$$ Equation derived from freebody diagram $F_{Rub} = 190.641$ lbf Force exerted on rubber grommet @ breakaway torque

CALCULATION OF SHAPE FACTOR AND MAXIMUM STRESS FOR CONTINUOUS LOADING

SF = Shape factor for rubber grommet (assuming grommet can expand only in the outward direction
OD = Outer diameter on rubber grommet
ID = Inner diameter on rubber grommet
L = Length of rubber grommet @ free position
$\sigma_{comp}$ = Compressive stress on rubber grommet
$\sigma_{cont}$ = Stress for continuous loading @ 15% for 70 DURO A soft Urethane in compression
$\eta$ = Safety factor $OD := 1.8$ in $ID = 1.0$ in $L = 1.0$ in $\sigma_{cont} = 140 \frac{lbf}{in^2}$ $$SF = \left(\frac{OD^2 - ID^2}{4(L)OD}\right)$$

$SF = 0.311$ Shape factor for rubber grommet

-continued

CALCULATION OF PRELOAD AND DEFLECTION DUE TO BREAKAWAY TORQUE ON RUBBER GROMMET $P_{pre}$ = Preload on rubber grommet (load @ installed)
$\delta_c$ = Deflection due to preload (a percentage of length L depending on preload desired)
A = Load area on rubber grommet
$E_c$ = Compressive modulus of elasticity for an 70 DURO A @ 15% compression
$\delta_{Rub}$ = Deflection on rubber grommet due to breakaway torque
L = Length of rubber grommet @ free position (value defined in previous page)

$$\sigma_{comp} = \frac{4F_{Rub}}{\pi(OD^2 - ID^2)}$$

$$\sigma_{comp} = 108.362 \frac{lbf}{in^2}$$ Compressive stress on rubber $$n = \frac{\sigma_{cont}}{\sigma_{comp}}$$

n = 1.292 Safety factor for continuous loading

CALCULATION OF PRELOAD AND DEFLECTION DUE TO BREAKAWAY TORQUE ON RUBBER GROMMET $P_{pre}$ = Preload on rubber grommet (load @ installed)
$\delta_c$ = Deflection due to preload (a percentage of length L depending on preload desired)
A = Load area on rubber grommet
$E_c$ = Compressive modulus of elasticity for an 70 DURO A @ 15% compression
$\delta_{Rub}$ = Deflection on rubber grommet due to breakaway torque
L = Length of rubber grommet @ free position (value defined in previous page)

$$E_c = 933.33 \frac{lbf}{in^2} \quad \delta_c = 0.10\ L$$

$$A = \frac{\pi}{4}(OD^2 - ID^2)$$

$$P_{pre} = \frac{E_c \cdot A}{L}\delta_c$$

$P_{pre}$ = 164.2 lbf Preload on rubber grommet (load @ installed)

$$^{\delta}Rub = \frac{F_{Rub}L}{E_c A}$$

$^{\delta}Rub$ = 0.116 in Deflection on rubber grommet due to breakaway torque $^{\delta}Ratchet = {}^{\delta}Rub - {}^{\delta}c$
$^{\delta}Rub$ = 0.116 in Deflection (depth) for ratchet feature
$E_c$ = 100 . . . 1000

$$^{\delta}Rub(E_c) = \frac{^{F}Rub^{L}}{E_c A}$$

Figure 10:
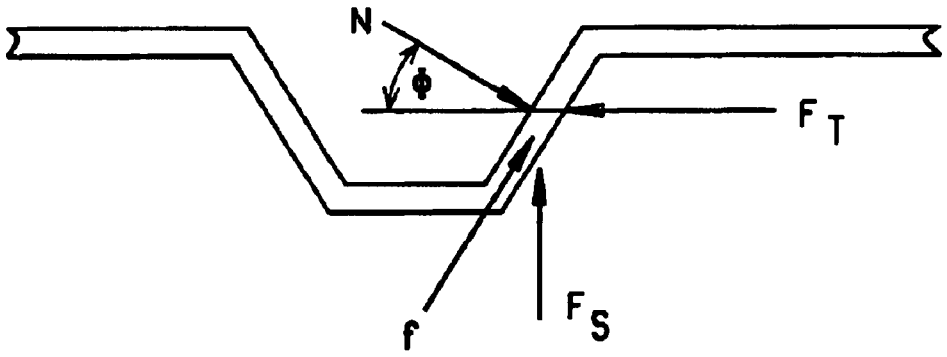
FIG. 10 is a schematic view of the inner hub teeth engaged with the drive sleeve teeth shown in FIG. 2.

FIG. 10 is a schematic view of drive sleeve teeth 128 engaged with inner hub teeth 152. Drive sleeve 118, inner hub 144, and biasing member 170 (shown in FIG. 2) form a ratchet assembly that permits outer hub 108 to rotate relative to propeller shaft 102 when a sufficient torque is applied to propeller 106. In one embodiment, drive sleeve 118 is fabricated from a resilient material and inner hub 144 is fabricated from brass. In an alternative embodiment, drive sleeve 118 is fabricated from brass and inner hub 144 is fabricated from a resilient material.

In the particular embodiment shown in FIG. 10, teeth 128 and 152 are tapered and are configured to provide for relative rotation of drive sleeve 118 to inner hub 144 at a preset torsional load. In one embodiment, the preset torsional load is 1000 ft-lbs. In the particular embodiment shown in FIG. 10, teeth 128 and 152 have a length of about 0.35 inches and include a pair of sidewalls angled with respect to longitudinal axis 138 of approximately 19.403 degrees. The configuration of teeth 128 and 152 is determined as follows.

TORQUE CALCULATIONS FOR TEETH ENGAGEMENT $F_S$ = spring force
$F_T$ = torque force = 1000 ft-lbs
$\phi_1$ = tooth angle
$\Sigma F_X = 0$ $$F_T = N\cos\phi_1 + f\sin\phi_1 \quad 1)$$

$\Sigma F_Y = 0$ $$F_S = -f\cos\phi_1 + N\sin\phi_1 \quad 2)$$

$f = \mu N$ $\mu$ = brass vs acetal $$F_T = N(\cos\phi_1 + \mu\sin\phi_1) \quad 1a)$$
$$F_S = N(-\mu\cos\phi_1 + \sin\phi_1) \quad 2a)$$

$$Fs = F_T\left(\frac{-\mu\cos\phi_1 + \sin\phi_1}{\cos\phi_1 + \mu\sin\phi_1}\right)$$

900 ft-lbs => 11,368 lbf
therefore, $F_S$ = 22.411 lbf approximate moment arm is about 0.95 in $$(.95\ in)(F_T) = 1000\ ft\ lbs$$

$$F_T = (1000\ ft\ lbs) \times \frac{12\ in}{(0.95\ in)(1\ ft)} = 12{,}632\ lbs$$

Determination of tooth angle given the spring force

Ft = 12632 lbf $\mu$ = 0.35
$\phi$ = 15 deg, 16 deg, 45 deg F3 = 24.917 lbf $$Fs(\phi) = \frac{Ft(\sin(\phi) - \mu\cos(\phi))}{\cos(\phi) + \mu\sin(\phi)}$$

Fs(19.403 deg) = 24.903 lbf

CALCULATION OF TEETH TORSIONAL SHEAR

J = .62648456 $in^4$ from section PS B-14
SLEEVE SECT. E AREA = 1.0534426 $in^2$ (6 teeth)
TORQUE: 1000 ft-lbs $$T = \frac{J\tau}{c} \quad c = 1.05\ in$$

$$\tau = \frac{Tc}{J} = \frac{1000\ ft\ lbs\left(\frac{12\ in}{ft}\right)(1.05\ in)}{0.62648456\ in^4}$$
$$= 70{,}112.23\ psi$$

Propeller assembly 100 facilitates easy replacement of inner hub 144. Specifically, in the event a user desires to replace inner hub 144, the user simply removes propeller assembly 100 from propeller shaft 102, and removes drive sleeve 118 and inner hub 144 from within outer hub 108. A replacement inner hub 144 and/or drive sleeve 118 can then be utilized when reassembling propeller assembly 100 and mounting assembly 100 on propeller shaft 102.

Further, different drive sleeves can be provided so that propeller 106 can be utilized on many different types of marine engines. For example, one particular marine engine may have splines on the propeller shaft of a first length, and another particular marine engine may have splines on a propeller shaft of a second length. Different drive sleeves having different length splines on their inner diameter surfaces can be provided. Although different drive sleeves are utilized, a same propeller can be used. That is, by providing interchangeable drive sleeves, one propeller can be used in conjunction with many different type engines.

Propeller assembly 100 can repeatedly handle impact torque load with no upper torque limit. Inner hub 144, drive sleeve 118 and biasing mechanism 170 accommodate impact loads for a life of biasing mechanism 170 or friction wear surfaces of drive sleeve 118 and inner hub 144.

It is contemplated that drive sleeve, inner hub, or both, could be sold in kit form. For example, different kits containing different drive sleeves specified for particular engine types could be provided. In one specific embodiment, a kit includes both a drive sleeve and a replaceable inner hub.

Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An interchangeable drive sleeve for a propeller assembly to secure a propeller to a propeller shaft, said drive sleeve comprising a first portion, and a second portion comprising a plurality of teeth, said second portion having a larger outer diameter than an outer diameter of said first portion, thereby forming a ledge extending between said first portion and said second portion, said ledge configured to engage a biasing mechanism causing said teeth to engage a hub, the biasing mechanism configured to be engaged between the ledge and an outer hub.

2. An interchangeable drive sleeve in accordance with claim 1 further comprising a plurality of splines extending from an inner diameter surface of said drive sleeve.

3. An interchangeable drive sleeve in accordance with claim 2 wherein a longitudinal length of said splines extending from said drive sleeve inner diameter surface is configured to mate with a length of splines extending from an outer diameter surface of the propeller shaft.

4. A replaceable inner hub for a propeller assembly to secure a propeller to a propeller shaft, said inner hub comprising a body, a plurality of generally sinusoidal keys formed on an outer diameter surface of said inner hub extending from said body, and a plurality of teeth at one end of said body, wherein the inner hub is constructed to be positioned on the propeller shaft prior to positioning the propeller thereon.

5. A replaceable inner hub in accordance with claim 4 wherein said teeth are tapered.

6. A replaceable inner hub in accordance with claim 4 further comprising a plurality of intermediate sections connecting the keys, the teeth extending from an end of the inner hub.

7. A kit for securing a propeller to a propeller shaft of a marine engine, the kit comprising:

a drive sleeve fabricated of brass comprising a first portion and a second portion, the second portion comprising a plurality of teeth, the second portion having a larger outer diameter than an outer diameter of the first portion;

an inner hub comprising a plurality of teeth and an outer diameter, the outer diameter forming a plurality of integrally formed keys, an outer diameter of the keys being larger than the outer diameter of the second portion of the drive sleeve; and a biasing mechanism contacting the drive sleeve and biasing the drive sleeve such that the drive sleeve teeth engage the inner hub teeth.

8. A kit in accordance with claim 7 wherein said drive sleeve teeth extend from an end thereof.

9. A kit in accordance with claim 7 further comprising a plurality of splines extending from an inner diameter surface of said drive sleeve.

10. A kit in accordance with claim 7 wherein said splines are configured to extend a length similar to a length of splines extending from an outer diameter surface of the propeller shaft.

11. A kit in accordance with claim 7 wherein said drive sleeve teeth and said inner hub teeth are tapered.

12. A kit in accordance with claim 7 wherein said inner hub circumferentially engages an outer hub and axially engages said drive sleeve such that said inner hub is fixed relative to said outer hub and rotatable relative to the drive sleeve.

13. A kit in accordance with claim 12 wherein said inner hub keys are configured to mate with an inner diameter surface of a propeller outer hub.

14. A propeller assembly for being secured to a propeller shaft of a marine engine, said propeller assembly comprising:

a drive sleeve comprising a first portion and a second portion, said second portion comprising a plurality of teeth and having a larger outer diameter than said first portion thereby forming a ledge between said first portion and said second portion;

an inner hub comprising an outer diameter and a plurality of teeth at an end thereof, said outer diameter comprising a plurality of keys integrally formed therewith, an outer diameter of said keys being larger than the outer diameter of said second portion of said drive sleeve;

a biasing mechanism contacting said drive sleeve at said ledge and biasing said drive sleeve such that said drive sleeve teeth engage said inner hub teeth;

said biasing mechanism comprises a helical spring contacting an end of said outer hub and said drive sleeve ledge; and a propeller comprising an outer hub comprising a cylindrical shaped body and a plurality of blades extending from an outer diameter surface of said outer hub body, an inner diameter surface of said outer hub body comprising a plurality of keyways, said keyways shaped to mate with said inner hub keys to limit relative movement between said inner hub and said outer hub.

15. A propeller assembly in accordance with claim 14 wherein a plurality of splines are in an inner diameter surface of said drive sleeve.

16. A propeller assembly in accordance with claim 14 wherein said drive sleeve teeth extend from said drive sleeve second portion.

17. A propeller assembly in accordance with claim 14 wherein said inner hub is fabricated from one of brass and a resilient material.

18. A propeller assembly in accordance with claim 14 wherein said drive sleeve is fabricated from one of brass and a resilient material.

19. A propeller assembly in accordance with claim 14 wherein said drive sleeve comprises an outer diameter sized to enable said drive sleeve to rotate relative to said outer hub.

20. A propeller assembly in accordance with claim 14 wherein said drive sleeve is configured to deflect axially away from said inner hub upon the occurrence of a sufficient torque so that said drive sleeve teeth disengage said inner hub teeth and said drive sleeve is able to rotate relative to said inner hub.

21. A propeller assembly for being secured to a propeller shaft of a marine engine, the propeller assembly comprising:

means for engaging said propeller shaft, the engaging means comprising a first portion and a second portion, the second portion comprising a plurality of teeth, the second portion having a larger outer diameter than an outer diameter of the first portion;

an inner hub comprising an outer diameter and a plurality of teeth at an end thereof, the outer diameter of the inner hub comprising a plurality of keys integrally formed thereon, an outer diameter of the keys being larger than the outer diameter of said second portion of the engaging means;

a propeller comprising an outer hub comprising a cylindrical shaped body and a plurality of blades extending from an outer diameter surface of the outer hub body, an inner diameter surface of the outer hub body comprising a plurality of keyways formed thereon, the keyways shaped to mate with the inner hub keys to limit relative movement between the inner hub and the outer hub; and means for biasing the engaging means from the outer hub of the propeller such that the engaging means teeth engage the inner hub teeth.

22. A propeller assembly in accordance with claim 21 wherein said engaging means comprises an inner diameter surface comprising a plurality of splines thereon.

23. A propeller assembly in accordance with claim 21 further comprising a ledge extending between said engaging means first portion and said engaging means second portion.

24. A propeller assembly in accordance with claim 21 wherein said biasing means comprises a helical spring contacting an end of said outer hub.

25. A propeller assembly in accordance with claim 21 wherein said inner hub is fabricated from one of brass and a resilient material.

26. A propeller assembly in accordance with claim 21 wherein said engaging means is fabricated from one of brass and a resilient material.

27. A propeller assembly in accordance with claim 21 wherein said engaging means comprises an outer diameter sized to enable said engaging means to rotate relative to said outer hub.

28. A propeller assembly in accordance with claim 21 wherein said engaging means is configured to deflect axially away from said inner hub upon the occurrence of a sufficient torque so that said engaging means teeth disengage said inner hub teeth and said engaging means is able to rotate relative to said inner hub.

* * * * *